US005692943A

United States Patent [19]

Copp

[11] Patent Number: 5,692,943

[45] Date of Patent: Dec. 2, 1997

[54] OPIHI PICKER TOY

[76] Inventor: Wyatt L. Copp, 45-553 Apapane St., Kaneohe, Hi. 96744

[21] Appl. No.: 650,955

[22] Filed: May 20, 1996

[51] Int. Cl.[6] ..... A63H 33/00

[52] U.S. Cl. ..... 446/75; 446/177; 273/DIG. 25

[58] Field of Search ..... 446/75, 177, 311, 446/312, 308, 309; 273/340, 447, DIG. 25; 473/572

[56] References Cited

U.S. PATENT DOCUMENTS 3,234,685 2/1966 Harrowe ..... 446/177

3,526,991 9/1970 Goldfarb et al. ..... 446/177

3,612,528 10/1971 Glass ..... 446/308 X

*Primary Examiner*—Mickey Yu

*Attorney, Agent, or Firm*—Michael I. Kroll

[57] ABSTRACT

An opihi picker toy (10) comprising a simulated opihi shellfish (12). A facility (14) is for securing the simulated opihi shellfish (12) to an adhering surface (16). An implement (18) is for releasing the simulated opihi shellfish (12) from the adhering surface (16). The simulated opihi shellfish (12) will be propelled upward about two inches from the adhering surface (16) by a popping effect. A component (20) is for storing the simulated opihi shellfish (12) after being removed from the adhering surface (16).

16 Claims, 3 Drawing Sheets

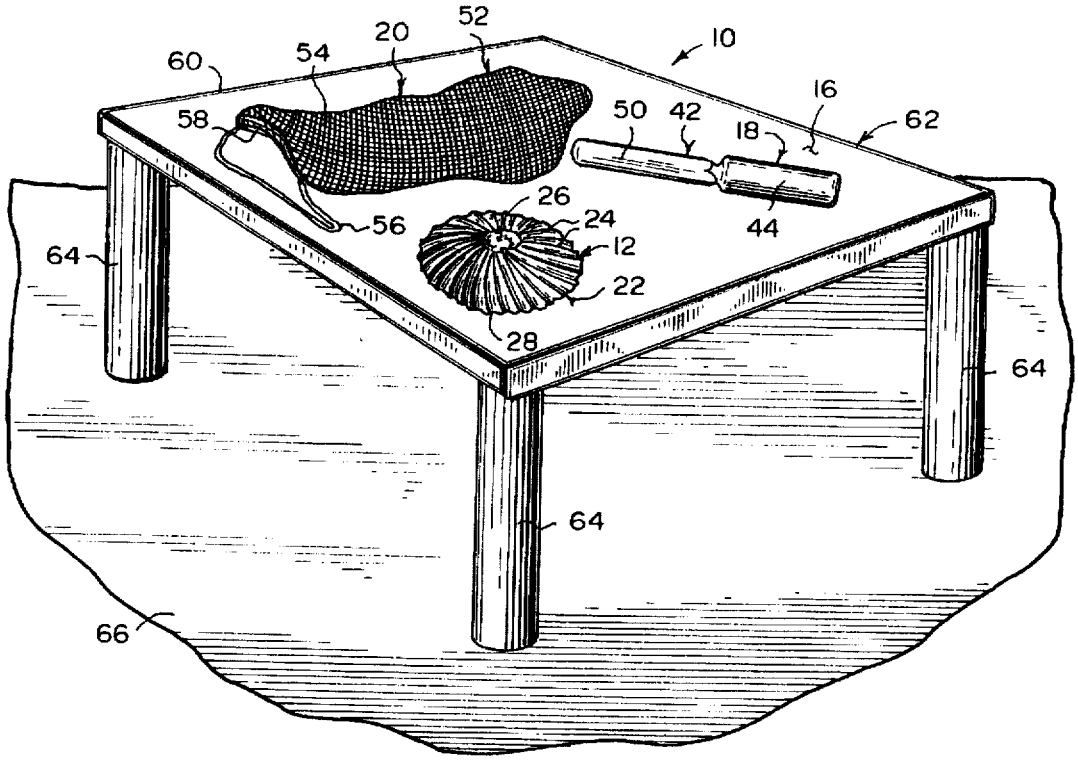
Fig. 1
Fig. 2a
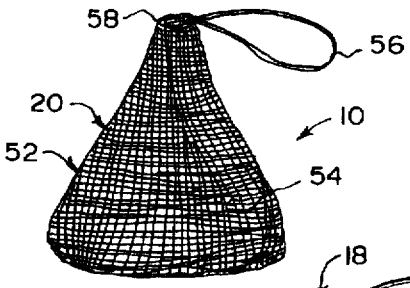
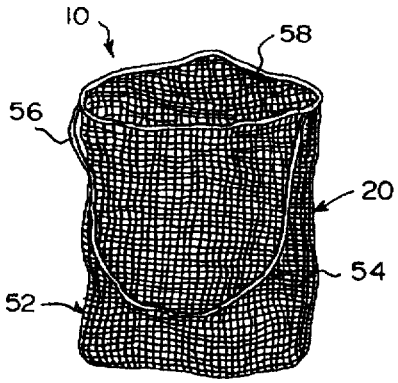
Fig. 2
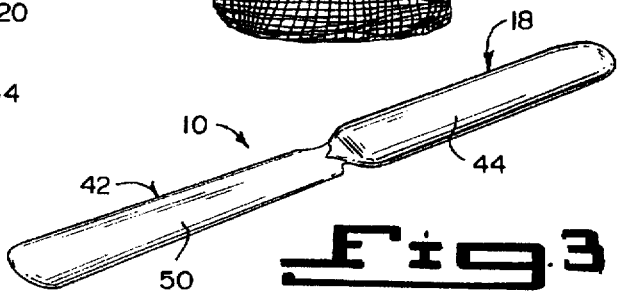
Fig. 3

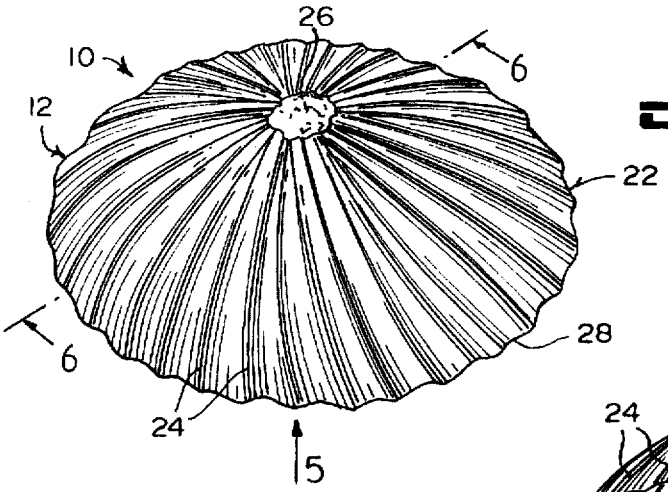
Fig. 4
Fig. 5
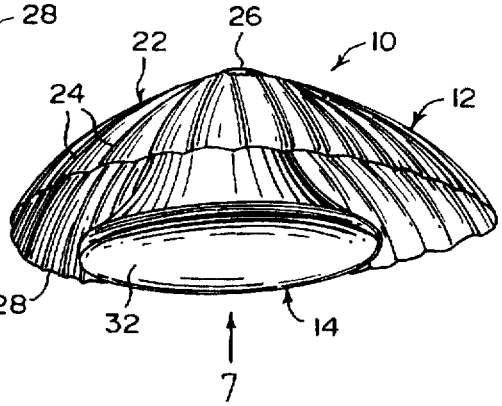
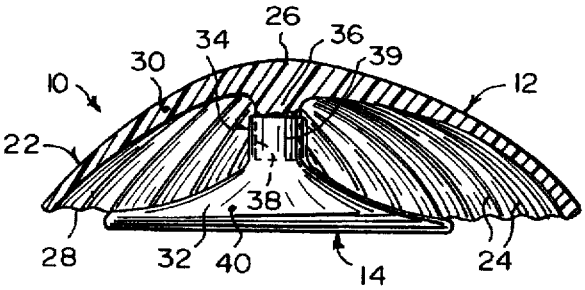
Fig. 6
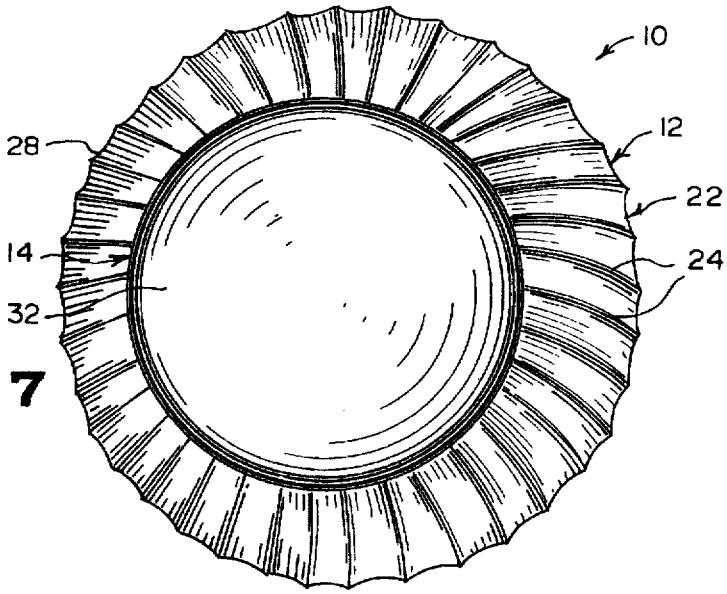
Fig. 7

Fig. 8
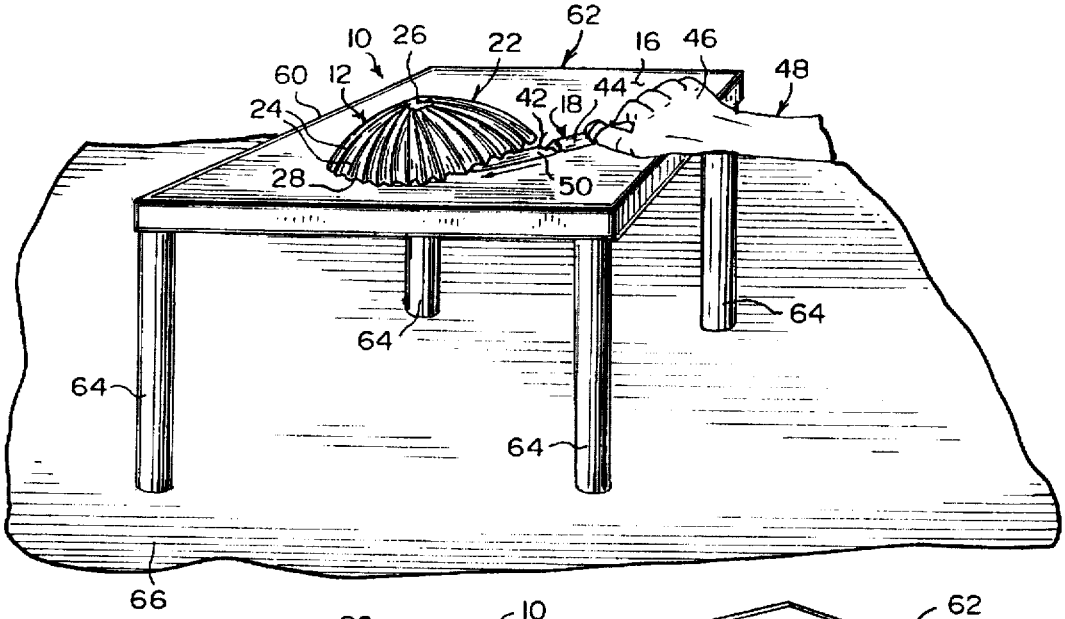
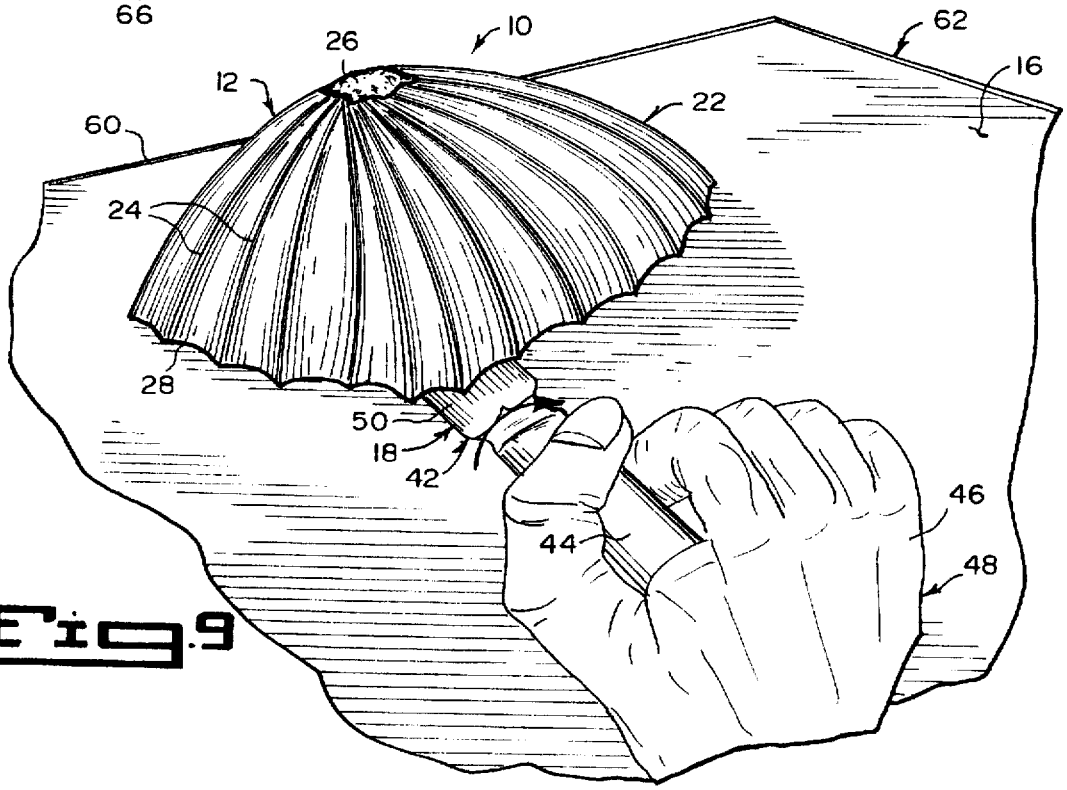
Fig. 9

OPIHI PICKER TOY

BACKGROUND OF THE INVENTION

1. Field of the Invention

The instant invention relates generally to toys and more specifically it relates to an opihi picker toy.

2. Description of the Prior Art

Numerous toys have been provided in prior art that are adapted to consist of items for children to play with. While these units may be suitable for the particular purpose to which they address, they would not be as suitable for the purposes of the present invention as heretofore described.

SUMMARY OF THE INVENTION

A primary object of the present invention is to provide an opihi picker toy that will overcome the shortcomings of the prior art devices.

Another object is to provide an opihi picker toy that will simulate an ancient Hawaiian sport of gathering opihi, a shellfish similar to abalone, since the inherent dangers of this sport along with over fishing makes it very difficult for children to participate in gathering the opihi.

An additional object is to provide an opihi picker toy, in which the opihi being an artificial conical shell lined with ridges has a suction cup attached to the bottom of the shell, that can be removed with a popping effect from an adhering surface with a twisting motion of a spatula and placed into a flexible closeable container in a safe manner by a child.

A further object is to provide an opihi picker toy that is simple and easy to use.

A still further object is to provide an opihi picker toy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of a table showing the various components of the instant invention placed thereupon.

FIG. 2 is an enlarged perspective view of the flexible closeable container in an opened condition.

FIG. 2*a* is an enlarged perspective view of the flexible closeable container in a closed condition.

FIG. 3 is an enlarged perspective view of the spatula.

FIG. 4 is an enlarged top perspective view of the simulated opihi shellfish.

FIG. 5 is an enlarged bottom perspective view taken in the direction of arrow 5 in FIG. 4.

FIG. 6 is a cross sectional view taken along line 6—6 in FIG. 4.

FIG. 7 is a bottom view taken in the direction of arrow 7 in FIG. 5.

FIG. 8 is a perspective view of the table, showing the elongated flat blade of the spatula being inserted under the simulated opihi shellfish adhered to the tabletop.

FIG. 9 is an enlarged perspective view, showing the elongated flat blade of the spatula being twisted to cause the simulated opihi shellfish to pop up off of the tabletop.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 9 illustrate an opihi picker toy 10, comprising a simulated opihi shellfish 12. A facility 14 is for securing the simulated opihi shellfish 12 to an adhering surface 16. An implement 18 is for releasing the simulated opihi shellfish 12 from the adhering surface 16. The simulated opihi shellfish 12 will be propelled upward about two inches from the adhering surface 16 by a popping effect. A component 20 is for storing the simulated opihi shellfish 12 after being removed from the adhering surface 16.

The simulated opihi shellfish 12 is an artificial conical shell 22 lined with a plurality of ridges 24 that radially extend from an apex 26 to a bottom edge 28 of the shell 22. The shell 22 is made out of a rigid plastic material 30, (see FIG. 6).

The securing facility 14 consists of a suction cup 32 and an assemblage 34, for fastening the suction cup 32 to the underside of the simulated opihi shellfish 12. The fastening assemblage 34, as shown in FIG. 6, includes a shank 36 extending downwardly from the underside and directly under the apex 26 of the simulated opihi shellfish 12. The suction cup 32 has a bore 38 in a top end 39. The shank 36 can be inserted into and engage with the bore 38 in the top end 39 and be retained by heat sealing. The suction cup 32 is made out of a flexible plastic material 40.

The releasing implement 18, as best seen in FIG. 3, is a spatula 42. The spatula 42 comprises a handle 44 to be grasped by a hand 46 of a person 48. An elongated flat blade 50 extends from the handle 44. The elongated flat blade 50 can be inserted between the securing facility 14 and the adhering surface 16, as shown in FIG. 8, and then be twisted to release the securing facility 14 from the adhering surface 16, as shown in FIG. 9.

The storing component 20, as shown in FIGS. 1, 2 and 2*a*, is a flexible closeable container 52, which includes a mesh bag 54 with a drawstring 56 about an open mouth 58 of the mesh bag 54. The adhering surface 16 can be a tabletop 60 of a table 62. A plurality of legs 64 will support the tabletop 60 in an elevated position above a floor 66, as best shown in FIGS. 1 and 8. The adhering surface 16 can also be a counter top or any other flat surface, not shown in the drawings.

OPERATION OF THE INVENTION

To use the opihi picker toy 10, the following steps should be taken:

1. Place the simulated opihi shellfish 12 upon the adhering surface 16, such as the tabletop 60 of the table 62.
2. Press the apex 26 with a finger, so that the suction cup 32 will stick to the adhering surface 16.
3. Grasp the handle 44 of the spatula 42 by the hand 46.
4. Insert the elongated flat blade 50 between the suction cup 32 and the adhering surface 16, as shown in FIG. 8.

5. Twist the elongated flat blade 50 to release the suction cup 32 from the adhering surface 16, as shown in FIG. 9, so that the simulated opihi shellfish 12 will be propelled upward about two inches from the adhering surface 16 by a popping effect.
6. Put the simulated opihi shellfish 12 into the mesh bag 54.
7. Pull the drawstring 56 to close the open mouth 58 of the mesh bag 54.

LIST OF REFERENCE NUMBERS

10 opihi picker toy
12 simulated opihi shellfish of 10
14 securing facility of 10
16 adhering surface
18 releasing implement of 10
20 storing component of 10
22 artificial conical shell for 12
24 ridge on 22
26 apex of 22
28 bottom edge of 22
30 rigid plastic material for 22
32 suction cup of 14
34 fastening assemblage of 14
36 threaded shank on 22 of 34
38 threaded bore in 39 of 34
39 top end of 32
40 flexible plastic material for 32
42 spatula for 18
44 handle of 42
46 hand of 48
48 person
50 elongated flat blade of 42
52 flexible closeable container for 20
54 mesh bag of 52
56 drawstring of 52
60 open mouth of 54
62 tabletop for 16 of 62
64 table
66 leg of 62
floor It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An opihi picker toy comprising:

a) a simulated opihi shellfish;

b) means for securing said simulated opihi shellfish to a surface; and c) spatula means for releasing said simulated opihi shellfish from the surface, so that said simulated opihi shellfish will be propelled upward about two inches from the surface by a popping effect.

2. An opihi picker toy as recited in claim 1, further including means for storing said simulated opihi shellfish after being removed from the surface.

3. An opihi picker toy as recited in claim 1, wherein said simulated opihi shellfish is an artificial conical shell lined with a plurality of ridges that radially extend from an apex to a bottom edge of said shell.

4. An opihi picker toy as recited in claim 3, wherein said shell is made out of a rigid plastic material.

5. An opihi picker toy as recited in claim 1, wherein said securing means includes:

a) a suction cup; and b) means for fastening said suction cup to the underside of said simulated opihi shellfish.

6. An opihi picker toy as recited in claim 5, wherein said fastening means includes:

a) a shank extending downwardly from the underside and directly under an apex of said simulated opihi shellfish; and b) said suction cup having a bore in a top end, so that said shank can be inserted into and engage with said bore in said top end and be retained by heat sealing.

7. An opihi picker toy as recited in claim 5, wherein said suction cup is made out of a flexible plastic material.

8. An opihi picker toy as recited in claim 1, wherein said spatula includes:

a) a handle to be grasped by a hand of a person; and b) an elongated flat blade extending from said handle, so that said elongated flat blade can be inserted between said securing means and the adhering surface and then be twisted to release said securing means from the adhering surface.

9. An opihi picker toy as recited in claim 2, wherein said storing means is a flexible closeable container which includes a mesh bag with a drawstring about an open mouth of said mesh bag.

10. An opihi picker toy as recited in claim 2, wherein said simulated opihi shellfish is an artificial conical shell lined with a plurality of ridges that radially extend from an apex to a bottom edge of said shell.

11. An opihi picker toy as recited in claim 10, wherein said shell is made out of a rigid plastic material.

12. An opihi picker toy as recited in claim 11, wherein said securing means includes:

a) a suction cup; and b) means for fastening said suction cup to the underside of said simulated opihi shellfish.

13. An opihi picker toy as recited in claim 12, wherein said fastening means includes:

a) a shank extending downwardly from the underside and directly under an apex of said simulated opihi shellfish; and b) said suction cup having a bore in a top end, so that said shank can be inserted into and engage with said bore in said top end and be retained by heat sealing.

14. An opihi picker toy as recited in claim 13, wherein said suction cup is made out of a flexible plastic material.

15. An opihi picker toy as recited in claim 14, wherein said spatula includes:

a) a handle to be grasped by a hand of a person; and b) an elongated flat blade extending from said handle, so that said elongated flat blade can be inserted between said securing means and the adhering surface and then be twisted to release said securing means from the adhering surface.

16. An opihi picker toy as recited in claim 15, wherein said storing means is a flexible closeable container which includes a mesh bag with a drawstring about an open mouth of said mesh bag.

* * * * *